US005497966A

United States Patent [19]

Fuhrmann

[11] Patent Number: 5,497,966

[45] Date of Patent: Mar. 12, 1996

[54] COLUMN UNIT, IN PARTICULAR A CHAIR COLUMN UNIT

[75] Inventor: Castor Fuhrmann, Brachtendorf, Germany

[73] Assignee: Stabilus GmbH, Koblenz-Neuendorf, Germany

[21] Appl. No.: 381,300

[22] Filed: Jan. 31, 1995

Related U.S. Application Data

[63] Continuation of Ser. No. 43,275, Apr. 6, 1993, abandoned.

[30] Foreign Application Priority Data

Apr. 11, 1992 [DE] Germany ..... 42 12 282.1

[51] Int. Cl.[6] ..... F16M 11/00

[52] U.S. Cl. ..... 248/161; 248/188.5; 248/406.1

[58] Field of Search ..... 248/161, 407, 248/414, 575, 578, 162.1, 631, 404, 188.5, 411, 406, 406.1, 406.2; 297/344.19

[56] References Cited

U.S. PATENT DOCUMENTS

| | | | |
|---|---|---|---|
| 1,919,114 | 7/1933 | Ley | 248/414 X |
| 1,955,772 | 4/1934 | Roth | 248/414 X |
| 3,788,587 | 1/1974 | Stemmler | 248/404 X |
| 3,870,271 | 3/1975 | Bowman | 248/406.2 |
| 4,415,135 | 11/1983 | French | 248/161 |
| 4,692,057 | 9/1987 | Lauderbach . | |
| 4,720,068 | 1/1988 | Tornero | 248/631 X |
| 4,756,496 | 7/1988 | Hosan et al. . | |
| 4,848,524 | 7/1989 | Hosan et al. . | |
| 4,940,202 | 7/1990 | Hosan et al. | 248/162.1 |
| 4,969,619 | 11/1990 | Bauer et al. . | |
| 4,979,718 | 12/1990 | Bauer et al. | 297/344.19 X |
| 5,114,109 | 5/1992 | Fitz et al. . | |
| 5,234,187 | 8/1993 | Teppo et al. . | |

FOREIGN PATENT DOCUMENTS

| | | | |
|---|---|---|---|
| 0511500 | 4/1992 | European Pat. Off. . | |
| 0483806 | 5/1992 | European Pat. Off. . | |
| 2165688 | 8/1973 | France . | |
| 426360 | 3/1926 | Germany . | |
| 621149 | 10/1935 | Germany . | |
| 827525 | 1/1952 | Germany | 248/161 |
| 1931012 | 11/1976 | Germany . | |
| 1529723 | 3/1977 | Germany . | |
| 2603488 | 4/1977 | Germany . | |
| 2816761 | 10/1979 | Germany . | |
| 523675 | 7/1972 | Switzerland . | |

OTHER PUBLICATIONS

Stabilus GmbH Drawing No. SK817287, 1 page.
Suspa Compart brochure, 2 pp.

*Primary Examiner*—Karen J. Chotkowski
*Attorney, Agent, or Firm*—Brumbaugh, Graves, Donohue & Raymond

[57] ABSTRACT

A column unit, in particular a chair column unit, including a base tube (310) and a pneumatic spring (318), further comprises an axially movable guide bushing (314) which is inserted in an axially movable manner in the upper end (310*b*) of the base tube (310), and which encloses an axially movable part (318*b*) of the pneumatic spring (318). An exit movement of the guide bushing (314) can be effected, e.g., by driver- or pusher-stops (326, 314*g*). The exit movement is restricted by pullout-restricting stops (316, 312*g*) which are releasable for the disassembly of the column unit.

26 Claims, 6 Drawing Sheets

COLUMN UNIT, IN PARTICULAR A CHAIR COLUMN UNIT

This application is a continuation of application Ser. No. 08/043,275, filed on Apr. 6, 1993 and now abandoned.

BACKGROUND OF THE INVENTION

The invention concerns a column unit, in particular a chair column unit, comprising a base tube with a base-tube axis, with a first base-tube end, and with guides inserted in the base tube in the area of the second base-tube end; furthermore comprising a positioning device, with a device axis which substantially coincides with the base-tube axis; with a first component-group unit and a second component-group unit, with these component-group units being movable axially to each other and lockable in a plurality of axial relative positions against each other; with furthermore the first component-group unit being supported, on a support connected to the base-tube, in a manner that is substantially immovable axially with respect to the base tube and which is, if applicable, rotatable with respect to the support; with furthermore the second component-group unit extending beyond the second base-tube end and being adjustable between an innermost position and an outermost position with respect to the second base-tube end; with furthermore an outer section of the second component-group unit, extending beyond the second base-tube end and beyond the guides, being shaped to connect with a column-borne object; and with the second component-group unit being in axially sliding engagement with the guides.

Such a column unit is known, for instance, from German Patent Document 19 31 012 and from U.S. Pat. No. 4,848,524. In the case of the known forms of embodiment, which have been eminently successful in practice, the guides are arranged in an axially attached manner with respect to the second (i.e., upper) base-tube end. This may cause the problem that the upper (i.e., second) component-group unit no longer has a sufficient guide length at the guides when the second component-group unit is in its outermost position. Moreover, this problem cannot be solved simply by increasing the length of the base tube while leaving the positioning device unchanged because such a lengthening of the base tube could possibly lead to a restriction in the travel of the positioning device, so that the shortest-possible position as designed for the column unit could no longer be achieved.

SUMMARY OF THE INVENTION

The invention addresses the task of designing a column unit such that, when the base-tube length is utilized close to the fullest extent (in order to permit a travel of the positioning device that is approximately equivalent to the length of the base tube), this positioning device continues to possess, via the second component-group unit, a guide length within the guides that is sufficiently long even in the outermost position of the second component-group unit. The following distinguishing features are provided for in order to achieve this task:

(a) The guides are guided in an axially shiftable manner along the base tube;

(b) the guides are capable of being driven on a partial path by the second component-group unit, when it moves outward between its innermost position and its outermost position;

(c) the outward movement of the guides with respect to the second tube-end is restricted by pullout-restricting jointly-acting stops, attached to the guides and to the base tube.

Due to the fact that the guides are axially shiftable with respect to the base tube and due to the fact that the guides are driven on a partial path by the second component-group unit, when it moves outward between its innermost and its outermost positions, the guide length of the second component-group unit forcibly adjusts to the length setting of the positioning device.

However, if now the guides are attached to the base tube in an "axially floating" manner, there could arise the danger that the guides reach a position of disengagement from the base tube, when the positioning device is wholly or partly moved out in the direction of the outermost position. This could occur, in particular, if the guides are accommodated in the base tube in a substantially frictionless manner and if, with such a design, the column unit is placed upside down, so that what originally was its upper end is located at the bottom. However, the loss of guidance of the guides on the base tube could also arise if, e.g., during cleaning by a wiping motion along the base tube, the guides are gripped and taken along in the pullout direction. In order to prevent this occurrence, the outward motion of the guides, with respect to the second base-tube end, is restricted by pullout-restricting jointly-acting stops connected to the guides and to the base tube.

It is recommended that the pullout-restricting stops be arranged in a manner such that they define an axial outer-limit position of the guides, in which position the second component-group unit, when it is in the outermost position with respect to the second base-tube end, is supported in an optimum manner on the base tube. This may mean, for instance, the following: when the second component-group unit is in its outermost position, it should be guided in the base tube for approximately one-half of its length; and, on the other hand, the other half of its length should surpass the second base-tube end, and should guide the second component-group unit. This makes it possible, without the loss of guidance, to move out the second component-group unit to an extent such that the end of the second component-group unit, which faces the first base-tube end, is located in the area of the second base-tube end, or even outside the second base-tube end.

Occasionally there arises the need to replace the pneumatic spring in a column unit, particularly a chair column-unit. For that purpose, the first component-group unit is connected with the pertinent support in a manner such that it can be easily released by a professional. This means that the positioning device can be easily dismounted from the column. In connection with the dismounting of the positioning device from the base tube, there occasionally arises the need (occurring in particular when there are driver- or pusher-stops at the positioning device and at the guides) to remove the guides from within the base tube, in order to replace worn guides, for instance, or in order to insert a different guide, in an adjustment to a different size of the positioning device. In order not to complicate the replacement of guides by the presence of the pullout-restricting stops, it is furthermore proposed that the pullout-restricting effect of the pullout-restricting stops be made capable of being overcome.

In this respect there are various possibilities: one can provide for the pullout-restricting effect of the pullout-restricting stops to be capable of being canceled by the application of a predetermined minimum pullout-force to the guides.

This general possibility can be implemented, e.g., in that the pullout-restricting stops comprise a pullout-restriction stop on the base-tube side and a pullout-restriction stop on the guides side, with the pullout-restriction stop on the guides side consisting of a pullout-restriction ring which is attached to an end area of the guides that lies within the base tube, which ring can be stripped off the guides via joint action with the pullout-restriction stop on the base-tube side, when the predetermined minimum pullout-force, or a greater pullout-force, are applied to the guides. In such a case, there exists the possibility of the pullout-restriction ring being elastically expandable and seated in an annular trough on an external-perimeter surface of the guides. In such a case, there furthermore exists the possibility of the pullout-restriction stop on the base-tube side being formed by the end of a centering tube which is inserted into the second base-tube end in an axially immovable manner, the centering-tube end being oriented towards the first base-tube end.

Another preferred possibility consists of the pullout-restricting stops being in principle non-releasable by the mere application of an axial pullout-force, yet susceptible to being rendered inoperative by at least one releasing step different from the application of a pullout force. Compared to the first possibility discussed, this possibility offers the advantage that the pullout-restricting effect of the pullout-restricting stops is also capable of absorbing large pullout forces, applied in the absence of any intention of dismounting the guides; and that, on the other hand, should the intention of dismounting the guides exist, they can be released with little expenditure of force. This design principle in turn encompasses several subordinated possibilities.

Thus, for instance, there exists the possibility of the pullout-restricting stops to include a base-tube slot running in an essentially axial direction, and a slot-engagement member linked to the guides for joint axial motion, which member acts in conjunction with one slot-end in restricting the outward motion of the guide, and which member can be disengaged from the slot. In such a case, one could envisage the slot-engagement member being disengageable from the guides; or furthermore, the slot-engagement member being elastically displaceable with respect to the guides, in conjunction with exiting from the slot.

A further possibility consists of the guides being twistable with respect to the base tube, and of the pullout-restricting stops being releasable, or capable of being placed in a release-ready position, by twisting the guides into a specific angulation range in relation to the base tube.

This possibility can be implemented, for instance, in that the pullout-restricting stop comprises an annular stop-edge attached below the base tube and substantially oriented axially to the first base-tube end; and a counter-stop, attached to the guides and substantially oriented radially inward, which counter-stop is adjustable, against an elastic restoring force, from an operating position into a release position, the counter-stop being brought into the release position by means of camming, when the guides are rotated in the direction of the predetermined angulation range.

Another implementing possibility consists in that the pullout-restricting stops comprise an annular stop-edge, attached within the base tube and substantially oriented axially towards the first base-tube end; and a counter-stop, attached to the guides and adjustable against an elastic restoring force, in a substantially radially-inward direction, from an operating position into a release position, the counter-stop being placed into the release position when the guides are twisted into the predetermined angulation range and, after a subsequent axial pullout motion of the guides, or, possibly, only after the partial pullout motion is followed by a renewed twisting of the guides with respect to the base tube, being disengageable through cam action into its release position. This last mode of implementation can be further elaborated in that the stop-edge features a recess and that camming is provided on the base tube, adjacent to this recess, for joint action with the counter-stop, which camming, after the counter-stop has been introduced into the recess and after a subsequent relative motion of the guides in relation to the base tube, causes a transfer of the counter-stop into the release position. In such a case, the camming can be arranged either in a manner such that the counter-stop, when located within the recess, is capable of being transferred to the release position by the axial pullout of the guides, or in a manner such that the counter-stop, when located within the recess, is capable of being transferred to the release position by twisting the guides with respect to the base tube. A combined application of the two methods of arranging the camming can also be envisaged.

For the simple production of a stop-edge without complicated machining of the base tube, one could form the stop-edge and the camming on a centering tube inserted in the base tube in the region of the second base-tube end. In such a case, the centering tube, like the guides, could be designed as a molded component (particularly a plastic-material molded component), easily made by injection molding.

A particularly economical way of producing the counter-stop consists of making the counter-stop from a section (such as an end section) of a wire strap inserted on an external-perimeter surface into an annular receiving trough; in that case, in the region of a notch of the guides which cuts into the annular trough, this section is displaceable radially inward against an elastic force, into the release position. In such a case, the possibility exists for the wire-strap section to be fixed in non-twistable fashion to the guides and to be rotatable into the angular range of a recess of the stop-edge by means of the rotation of the guides with respect to the base tube; and for camming to be provided on the base tube, adjacent to this recess, which camming, after the section has been introduced into the recess, and a subsequent relative motion of the guides in relation to the base tube has been effected, transfers the section into the release position. In such a case, the simplest way of achieving the non-rotatable fixation of the wire strap is by forming this wire strap, at its other end (distant from the end section), into a hook that engages the notch in a rotation-impeding manner.

In particular, the camming can be arranged in a manner such that, after having been inserted into the recess, the section of the wire strap is transferable into the release position by rotating the guides in relation to the base tube. Then the following manipulation possibility exists for the dismounting of the guides: The guides with the counter-stop attached to them are rotated while the counter-stop lies in contact with the stop-edge. As soon as the counter-stop enters the angular region of the recess, the operator feels the coincidence of the counter-stop (i.e., of the wire-strap end) with the recess, the operator certainly feeling such coincidence if, during the rotating motion, the operator exerts on the guides a slight force in the pullout direction. As soon as that coincidence is felt, the operator knows that the pullout movement can be applied to the guides. Therewith, the counter-stop (i.e., the wire-strap section, for example) enters the region of the recess. At this point, the counter-stop can be transferred to the release position by applying to the guides either a tensile force or a rotational moment, depending on the cam design of the recess-limiting border. In a specific angular region, one can achieve, via the design of the springing characteristics of the counter-stop and via the design of the camming, for the counter-stop to be transferred to the release position with relatively little effort, with the magnitude of the tensile force (or of the rotational moment) being adjusted in a manner such that even in this specific angular region there still prevails a certain resistance against the release, though manual release without recourse to special tools is nonetheless possible. This provides a level of safety that in practice suffices to guard against the unintentional pullout of the guides: to begin with, it is most improbable that the guides will enter the specific angular region at all, since that region is very small in comparison to the overall perimeter of the stop-edge. Still, even in this specific angular region, a certain pull or a certain torsion must be exerted in order to transfer the counter-stop to the release position.

In order to ensure a highly effective pullout restriction when the wire strap is in the region of rotation outside the specific angular region, even in the case of a relatively small-size spring-wire strap, it is recommended that when the wire-strap section is positioned in a region of rotation outside the recess, it engage in a hook-like manner into a radial gap between the stop-edge and an internal-perimeter surface of the base tube. Such hooking-type action can be easily achieved by providing the spring wire with a 180° bend that is hard to undo. The radial gap can be formed via spacers between a centering tube introduced into the second base-tube end and an internal-perimeter surface of the base tube.

The guides are capable of being driven in at least one axial direction of motion by frictional engagement with the second component-group unit. Alternatively, there exists the possibility of guides capable of being driven by the second component-group unit in at least one axial direction of movement, by means of driver- or pusher-stops, with clearance for movement. A preferred form of embodiment consists in the guides being driven, at least in the direction of being pulled out of the base tube, by driver- or pusher-stops, with clearance for movement so that when the positioning device is extended, the guides will nonetheless reach their guide-extending position soon enough. In such a case, a subsequent inward motion can once again be achieved by driver- or pusher-stops. Available for that purpose are, on one hand, the outer end of the guides and, on the other hand, an annular collar on the second component-group unit; in the most simple case, this annular collar can be formed by the lower end of the object carried by the column, e.g., a seat-fastening hub. As a result, the guides are movable in an axial direction between two driver- or pusher-stops that exist on the second component-group unit. In such a case, the need for releasability of the guides from the base tube becomes particularly important to permit the removal of the positioning device from the base tube at all, and to do so together with the guides. Once the positioning device has been dismounted, it becomes easy thereafter to pull off the guides because by then the stop that drives the guides in an outward direction is accessible and can be released from the second component-group unit. A particularly advantageous design for a stop that will drive the guides in an outward direction consists of a spring-steel claw ring attached to an end section of the second component-group unit which end section faces the first base-tube end, with the spring-steel claw ring coming to lie against a drive surface of the guides when the second component-group unit moves in an axially outward motion with respect to the base tube. Normally, such a claw ring cannot be pulled off from the second component-group unit by means of axial force, yet is easily dismountable by a releasing tool as soon as the ring is accessible. In such a case, the claw ring could engage, e.g., with the free ends of its claws a cylindrical external-perimeter surface of an end of the second component-group unit. The ring part that carries the claws is then located with its claws radially outward, with a shoulder surface creating a stop effect between a radially internal guidance-surface of the guides and a larger-diameter recess, whereby this recess permits free passage for the claw ring over a partial length of the guides.

The use of the claw ring is not restricted to the application of pullout-restricting stops, but can also be used when such stop-restricted pullouts are not present.

The use of pullout-restricting stops is furthermore not restricted to the case in which the first component-group unit is supported in a substantially axially immovable manner with respect to the base tube. Rather, such pullout-restricting stops can be used advantageously even when the first component-group unit supports itself on a variable-height platform, whose height is determined by a block-and-pulley which is controlled by the relative motion of the two component-group units.

DETAILED DESCRIPTION

Figure 1:
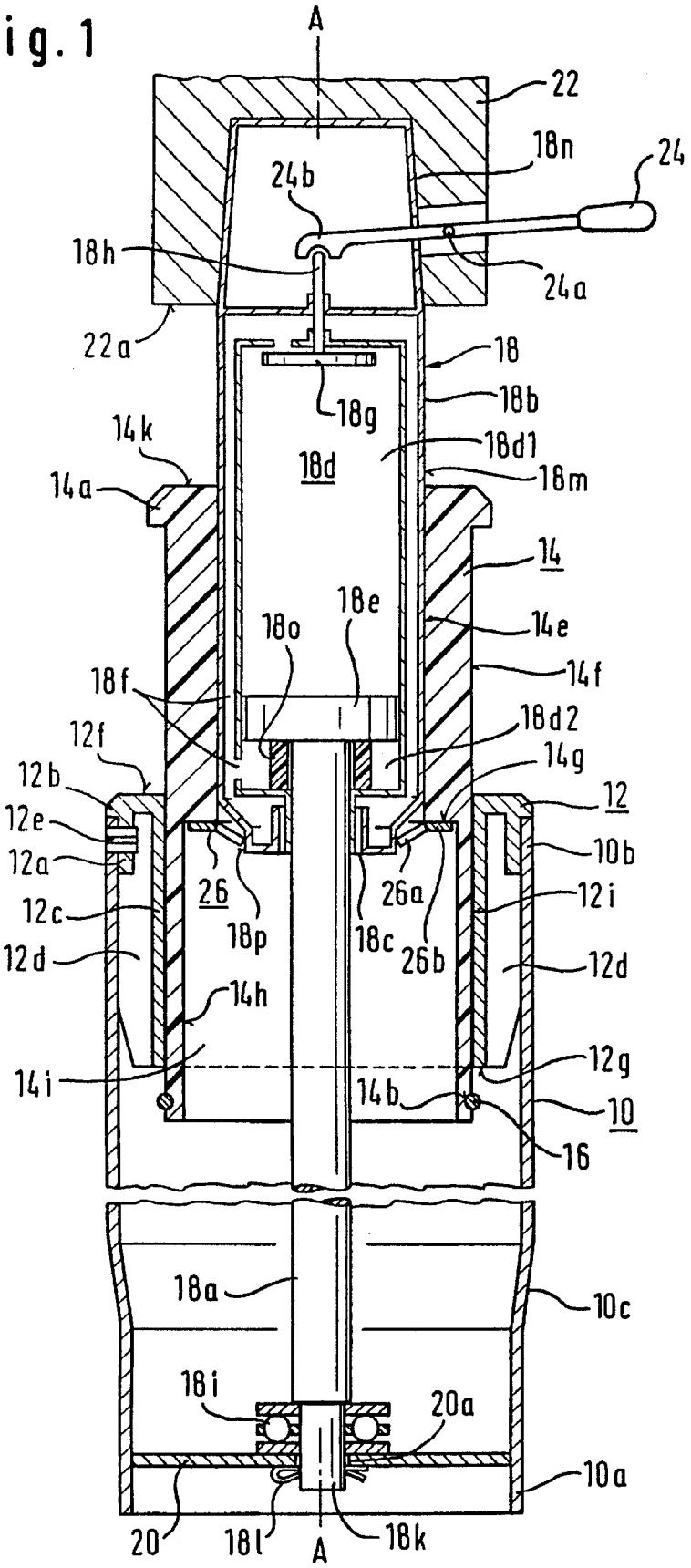
FIG. 1 is a cross section of a column unit in accordance with a first preferred embodiment of the invention.

In FIG. 1, a base tube is designated 10. This base tube features a first, or lower, end 10*a* and a second, or upper, end 10*b*. On the shell of base tube 10 a conical section 10*c* is provided, for the insertion of the base tube into a carrier such as a chair cross (not shown). A centering tube 12 is inserted into the upper end 10*b*. This centering tube 12 is centered in the base tube 10 by an annular flange 12*a* and is laid upon the upper end 10*b* of the base tube by means of a radial flange 12*b*. In addition centering-tube 12 features an inner shell 12*c* which is radially supported by radial ribs 12*d* against the internal-perimeter surface of base tube 10. Centering tube 12 is secured, radially and with respect to rotation, by at least one slotted/grooved dowel pin 12*e* on the base tube.

A guide sleeve 14 is inserted in centering tube 12. This guide sleeve displays at its upper end a collar 14*a* protruding radially outward, designed for stop-type engagement with the upper end 12*f* of the centering tube. An annular trough 14*b* is sunk into the lower end of the guide sleeve and accommodates an elastically expandable pullout-restriction ring 16. The pullout-restriction ring 16 faces opposite, in an axial direction, a lower end-edge 12*g* of centering tube 12. It can be seen that the guide sleeve is shiftable along a restricted path, axially with respect to centering tube 12. A lower or basic position of guide sleeve 14 is defined by the fact that collar 14*a* rests on the upper end 12*f* of centering tube 12. An upper or outer end-position of guide sleeve 14 is defined by the fact that pullout-restriction ring 16 lies against lower edge 12*g* of centering tube 12.

A pneumatic spring 18 is provided. The pneumatic spring 18 comprises as a first, or lower, component-group unit a piston rod 18*a*. It further comprises as an upper, or second, component-group unit a cylinder 18*b*. Piston rod 18*a* is inserted via a guide- and seal-unit 18*c* into the cavity 18*d* of cylinder 18*b* and carries within the cylinder a piston assembly 18*e* which subdivides cavity 18*d* into two working chambers 18*d*1 and 18*d*2. The two working chambers 18*d*1 and 18*d*2 are connected to each other by means of an annular channel 18*f*. This connection can be closed by a valve body 18*g*, the valve body being subjected in its closed position to the gas pressure prevailing in cavity 18*d*, and being controlled through a stem 18*h* in a sealed and slidable manner. By pushing down on stem 18*h* and therefore on valve body 18*g*, a connection can be established between the two working chambers 18*d*1 and 18*d*2. The lower end of the piston rod 18*a* is supported by a thrust-type ball-bearing 18*i* on a supporting wall 20, the latter being solidly connected with the base tube. At the same time, a lower-end continuation 18*k* of piston rod 18*a* is passed through a hole 20*a* in supporting wall 20 and axially fixed by a cotter pin 18*l*. In such a case, end continuation 18*k* has a little radial play in hole 20*a*.

Cylinder 18*b* is guided with an external perimeter-surface 18*m* against an internal perimeter-surface 14*e* of guide sleeve 14. On the other hand, guide sleeve 14 is guided with an external perimeter-surface 14*f* against an internal perimeter-surface 12*i* of centering tube 12.

Cylinder 18*b* is designed with its upper end-region as a cone 18*n*. The hub body 22 of a seat carrier is stuck onto cone 18*n* by means of an appropriate hollow cone. A release lever 24, pivotable in the plane of the paper around a pivot 24*a*, is supported in hub body 22. The release lever 24 penetrates through the conical section 18*n* of cylinder 18*b* and, by means of a socket 24*b*, acts on valve stem 18*h*.

In FIG. 1, the pneumatic spring is shown in its outermost position, i.e., the piston rod 18*a* is in its outermost position in relation to cylinder 18*b*. This outermost position is defined by an elastic stop-ring 18*o*.

After the valve body 18*g* has been opened, cylinder 18*b* can be pushed downward against the gas pressure until the piston unit 18*e* reaches the region of the valve body 18*g* where, if applicable, it defines an innermost position by means of a push-in restriction stop (not shown).

A claw ring 26 is attached at the lower end of cylinder 18*b* in the region of guide- and seal-unit 18*c*, the claw ring's claws 26*a* gripping an external-perimeter surface 18*p* of cylinder 18*b*. An annular disk 26*b* carrying claws 26*a* is in stop-type engagement with an annular shoulder 14*g* which is formed at the junction the internal-perimeter surface 14*e* of the guide sleeve and the internal-perimeter surface 14*h* of an annular recess 14*i* of guide sleeve 14. It can be seen that, via claw ring 26, cylinder 18*b* brought guide sleeve 14 into the position shown when it moved to the outermost position shown in FIG. 1. It is true that in this position, the lower end of cylinder 18*b* is approximately at the height of the upper end 10*b* of base tube 10. Nonetheless, sufficient guidance and centering of cylinder 18*b* are assured, on the one hand because cylinder 18*b* lies against perimeter surface 14*e* of guide sleeve 14 and furthermore because the lower part of guide sleeve 14 lies with its external-perimeter surface 14*f* against the internal-perimeter surface 12*i* of centering tube 12.

After a renewed opening of the valve body 18*g*, the cylinder can be pushed downward against the effect of the gas pressure upon the cross-section of the piston rod; at the same time, the gas passes between the two working chambers 18*d*1 and 18*d*2. In such a downward movement of cylinder 18*b*, guide sleeve 14, which is guided in centering tube 12 in a loose and practically friction-less manner, drops down because of gravity, while remaining in contact with claw ring 26. As soon as collar 14*a* of guide sleeve 14 hits against the upper end 12*f* of centering tube 12, guide sleeve 14 stops; cylinder 18*b* can then be pushed further down until such time as the lower end-surface 22*a* of hub body 22 hits against the upper end-surface 14*k* of guide sleeve 14. It is also conceivable that guide sleeve 14 is guided in centering tube 12 with a degree of friction that counteracts the dropping-off of guide sleeve 14 under the effect of gravity, so that, in a downward movement of cylinder 18*b*, guide sleeve 14 first remains in the position shown in FIG. 1 and is only driven downwards when lower end-surface 22*a* hits against upper end-surface 14*k* of guide sleeve 14 and then drives the guide sleeve downwards. The position of cylinder 18*b* with respect to piston rod 18*a* can be locked in any intermediate position by closing valve body 18*g*.

It can be seen that not even in the uppermost position of cylinder 18*b*, illustrated in FIG. 1, can guide sleeve 14 be substantially pulled upward out of its outermost position shown in FIG. 1: that is resisted by pullout-restriction ring 16, which comes to a stop against the lower edge 12*g* of centering tube 12. This ensures that, no matter what, when cylinder 18*b* is in its critical uppermost position, guide sleeve 14 cannot leave its position (shown in FIG. 1), of optimum guidance and centering for cylinder 18*b*.

To dismount pneumatic spring 18 from base tube 10, cotter pin 18*l* is released. However, at this point the pneumatic spring still cannot be pulled out of base tube 10, because it hits with claw ring 26 against the shoulder surface 14*g* of guide sleeve 14, while on the other hand, the guide sleeve hits with pullout-restriction ring 16 against lower edge 12*g* of centering tube 12. The elasticity of pullout-restriction ring 16 and the depth of annular trough 14*b* are matched with each other in a manner such that pullout-restriction ring 16 can be stripped off from the lower end of guide sleeve 14 with a predetermined minimum pullout force. In such a case, this minimum pullout force is fixed at a level such that pullout-restriction ring 16 is stripped off guide sleeve 14, e.g., before claw ring 26 releases cylinder 18*b*. As soon as pullout-restriction ring 16 has been stripped off guide sleeve 14, cylinder 18*b* with guide sleeve 14 can be pulled out of base tube 10. Next, claw ring 26 can be released from the lower end 18*p* of cylinder 18*b*, by means of a screw driver or similar tool. With this form of embodiment, the only way to remount a pneumatic spring or a guide sleeve is by also releasing and remounting centering tube 12. It is true that conceivably one could also think in terms of accommodating pullout-restriction ring 16 in annular trough 14*b* with an insertion-guiding cone provided at the upper end of inner shell 12*c* in a manner such that pullout-restriction ring 16 could be pushed in again, under radial compression, until the ring, having passed below lower edge 12*g* of centering tube 12, had returned to an operating stop position.

Figure 2:
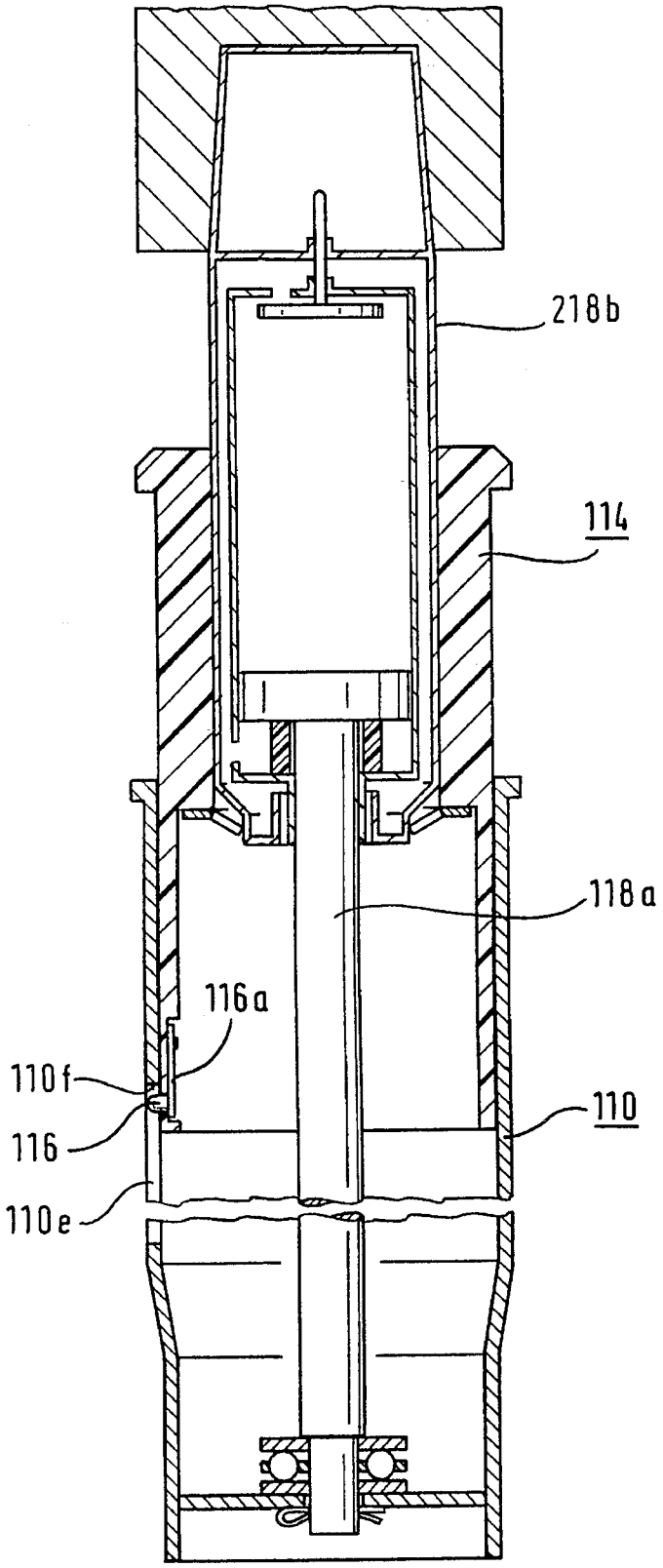
FIG. 2 is a cross section of a column unit in accordance with a second preferred embodiment of the invention.

In the form of embodiment according to FIG. 2, analogous components are designated by the same reference marks as in the form of embodiment according to FIG. 1, increased by 100.

The only difference from the embodiment according to FIG. 1 is the means that prevent excessive pullout of guide sleeve 114 from base tube 110. Visible in FIG. 2 is a pullout-restriction pin 116 which, under the influence of a leaf spring 116*a* supported on guide sleeve 114, engages in slot 110*e*. Pullout-restriction pin 116 operates in conjunction with the upper end 110*f* of slot 110*e*, preventing the unintentional pullout of guide sleeve 114 from base tube 110. Should further dismounting work make it necessary, pullout-restriction pin 116 can be shifted radially inward with respect to the guide sleeve that carries it by means of a screw driver or similar tool, after which guide sleeve 114 can be pulled out of base tube 110.

In other respects, the form of implementation of FIG. 2 is equivalent in its construction and operation to that of FIG. 1.

In the form of implementation according to FIG. 3, once again analogous components are designated by the same reference marks as in the form of implementation according to FIG. 1, respectively increased by 200. In this form of embodiment, one recognizes once again pullout-restriction pin 216, previously encountered in FIG. 2, the pin being pre-tensioned into an operating position by leaf spring 216*a*. By rotating guide sleeve 214, this pullout-restriction pin can be turned into the narrow angular region of a downwards-pointing extension 212*m*. At its edges, this extension 212*m* is provided with cam surfaces 212*n*, so that when pullout-restriction pin 216 is turned from its position in FIG. 3 to radial alignment with extension 212*m*, pullout-restriction pin 216 is pushed back radially inward into a release position; guide sleeve 214 can then be easily pulled out in an axial direction.

Consequently, pullout is only possible in a restricted angular region of the rotational path of guide sleeve, a position which for statistical reasons alone is most rarely assumed. A further reason why the release position is not reached accidentally is that when one slides pullout-restriction pin 216 over one of the two cam surfaces 212*n*, a certain rotational moment must be overcome. By adjusting the resilient force of leaf spring 216 and the inclination of cam surfaces 212, this rotational moment is set in a manner such that, on the one hand, the unintentional placement of pull-out-restriction pin 216 in radial alignment with extension 212*m* is rendered improbable, while, on the other hand, the way is opened to sliding pullout-restriction pin 216 upon extension 212*m*, preparatory to an intentional release of guide sleeve 214 by means of a relatively small manually applied rotational moment.

Figure 4:
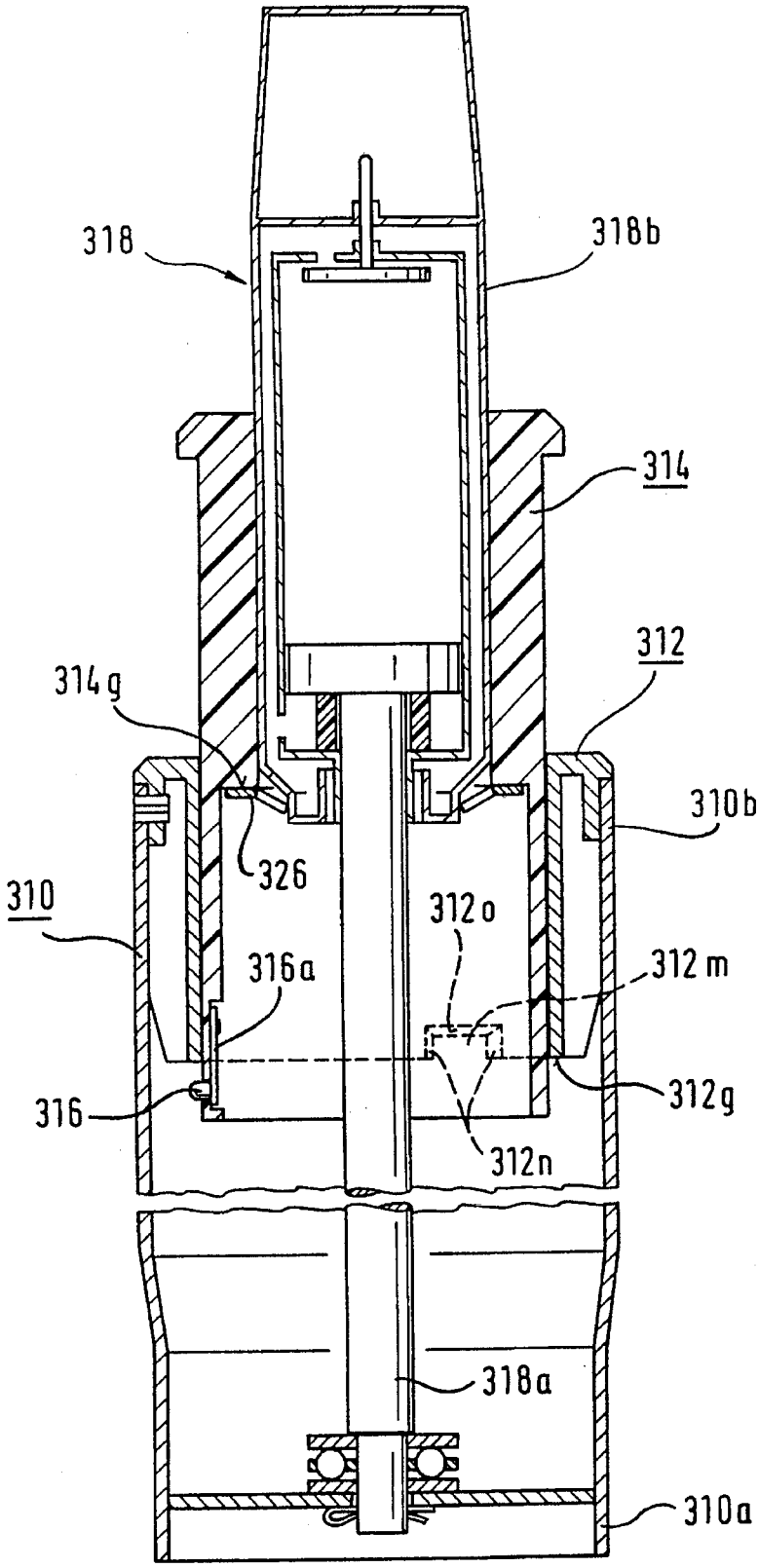
FIG. 4 is a cross section of a column unit in accordance with a fourth preferred embodiment of the invention.

In the form of embodiment according to FIG. 4, analogous components are designated by the same identifying marks as in the form of embodiment according to FIG. 1, respectively increased by 300.

Figure 3:
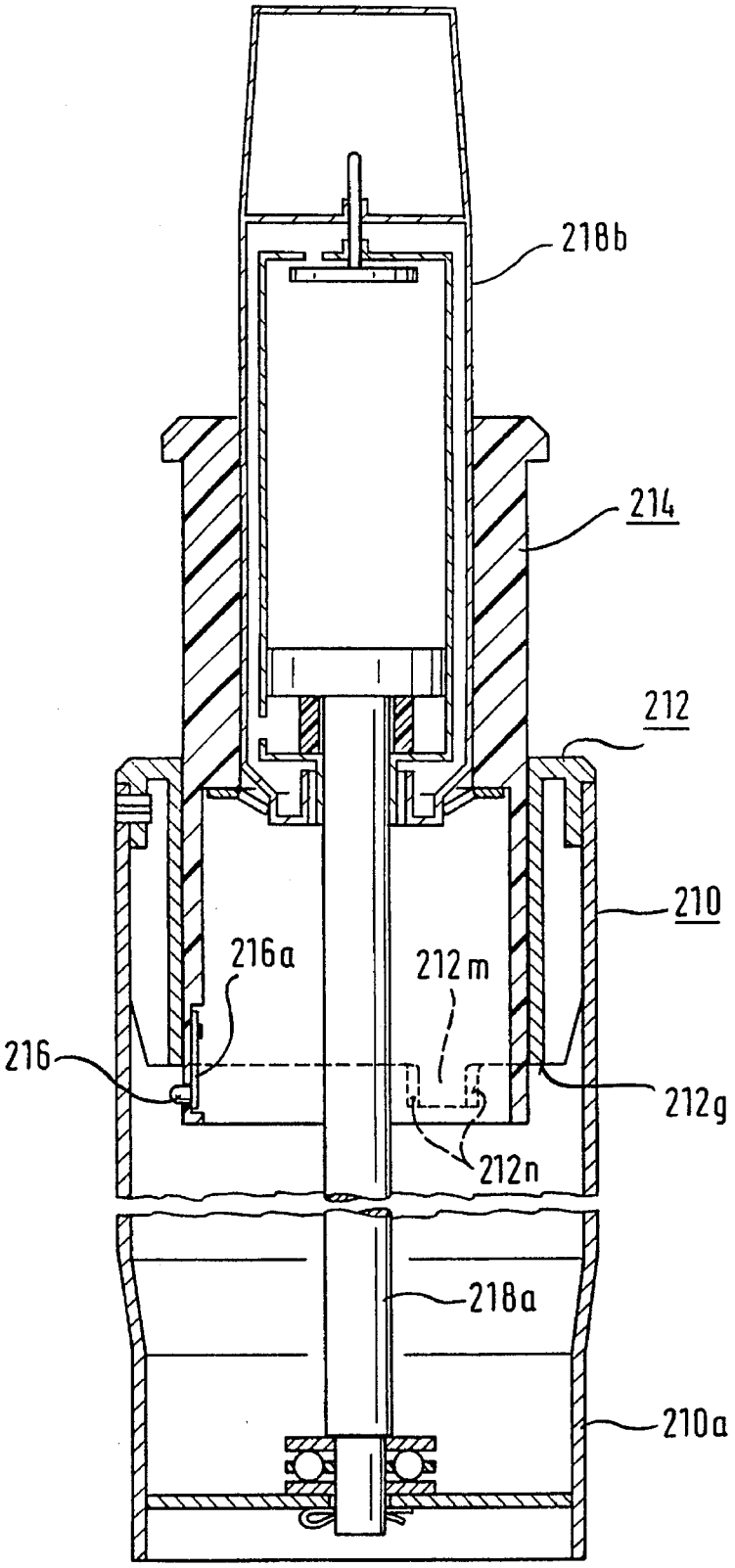
FIG. 3 is a cross section of a column unit in accordance with a third preferred embodiment of the invention.

The form of embodiment according to FIG. 4 differs from that in FIG. 3 only in that instead of extension 212*m* of centering tube 212, a recess 312*m* is provided in the lower edge 312*g* of centering tube 312, which recess is framed in by cam surfaces 312*n* and 312*o*. In this case, release is possible by first rotating pullout-restriction pin 316 along lower edge 312 into the region of recess 312*m* and then axially pulling off pullout-restriction pin 316 over cam surface 312*o*; or by twisting guide sleeve 314 with respect to centering tube 312 and rotating off over one of the cam surfaces 312*n*, thereby pushing it back into the release position.

Figure 5:
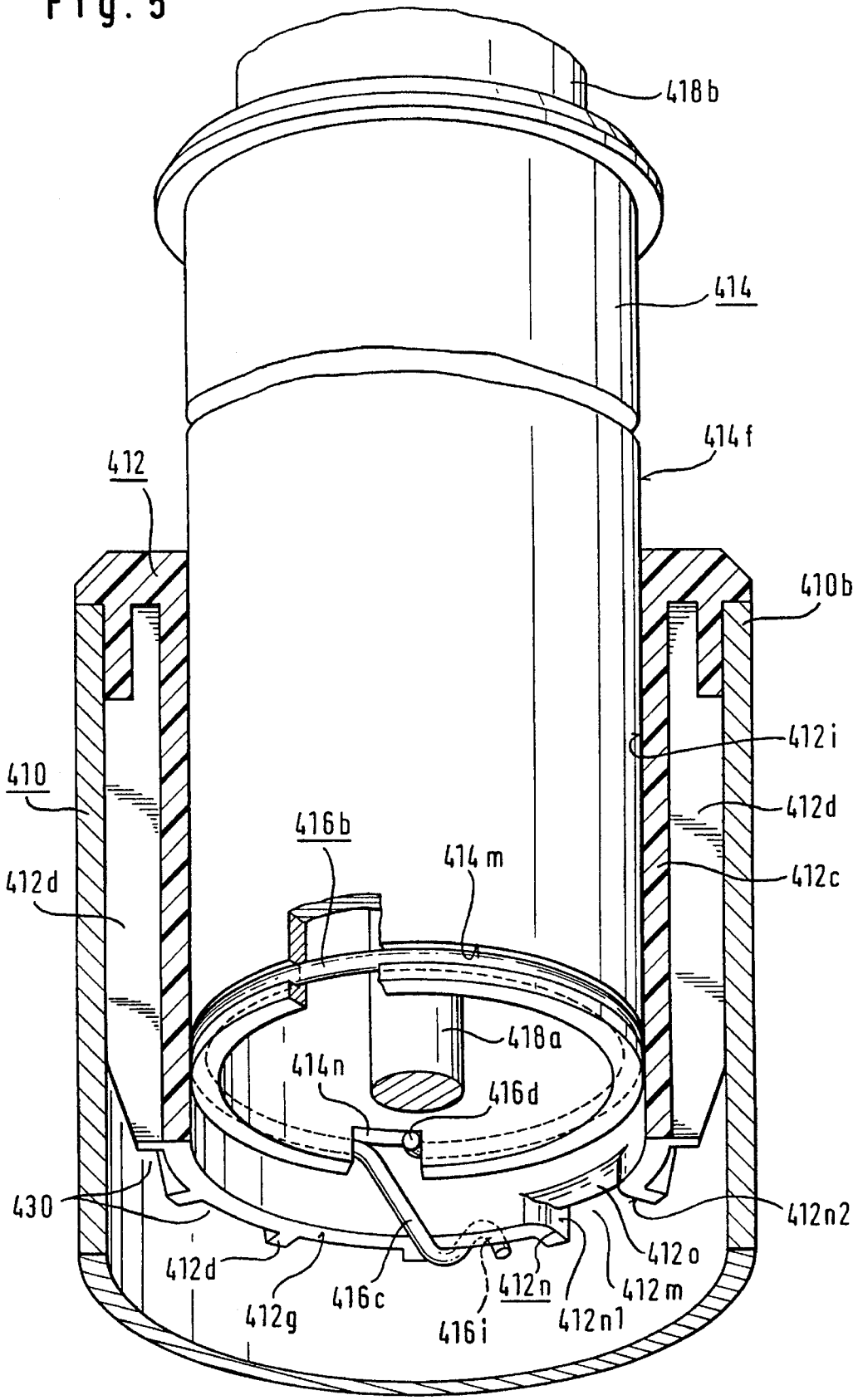
FIG. 5 is a partial cross section and partial perspective of a variant of the embodiment of FIG. 4.

In the form of embodiment according to FIG. 5, analogous components are designated by the same identifying marks as in the form of embodiment according to FIG. 1, respectively increased by 400.

The form of embodiment according to FIG. 5 differs from the one according to FIG. 4 by a different design of the counter-stop: in lieu of pullout-restriction pin 316 there is an end section 416*c* of a wire strap 416*b*. This wire strap 416*b* is laid into a annular trough 414*m* on external-perimeter surface 414*f* of guide sleeve 414. Wire strap 416*b* is secured with respect to rotation by a tail 416*d* of wire strap 416*b* engaging a notch 414*n* in a hook-like manner. Wire strap 416*b* is secured in a radial direction by lying against the internal-perimeter surface 412*i* of centering tube 412. Notch 414*n* cuts into annular trough 414*m*, so that, within the area of this notch, end-section 416*c* of wire strap 416*b* is free and can be bent in a radially inward spring-like manner.

End section 416*c* is provided with an end hook 416*i* which is capable of reaching around lower edge 412*g* of centering tube 412 and engaging into the gaps 430 between base tube 410 and internal shell 412*c* of centering tube 412, so long as guide sleeve 414 is pulled upwards (i.e., outward) and the end section of the wire strap reaches the region of lower edge 412*g* of centering tube 412. It is only when guide sleeve 414 is so angularly placed with respect to the centering tube 412 that end section 416*c* coincides with the angular region of recess 412*m*, that end section 416*c* enters recess 412*m* when guide sleeve 414 is shifted upward. After this has occurred and upon the subsequent twisting of guide sleeve 414 with respect to centering tube 412, end section 416*c* or its end hook 416*i* can engage with one of the cam surfaces 412*n*; end section 416*c* can then be pushed radially inward in the region of notch 414*n*, by pulling end hook 416*i* over one of the cam surfaces 412*n*. Next, guide sleeve 414 can be pulled off in an upward direction without any difficulty. If end hook 416 were designed in a different shape, there would also exist the possibility of this end hook acting jointly with cam surface 412*o*, letting the end hook be moved radially inward into its release position, by pull-off in a purely axial direction.

In the form of embodiment herein described, an unintentional release of guide sleeve 414 from centering tube 412 is particularly improbable if the distance-maintaining ribs 412*d* are continued until lower edge 412*g* because in such a case, recess 412*m* must first be located by stepwise turning of guide sleeve 414, each turn being followed by an attempt at pullout. In order to make the accidental dismounting of guide sleeve 414 even more improbable, one could modify cam surfaces 412*n* in recess 412*m* in a manner such that only a single operative cam surface 412*n*1 is created, while the other cam surface 412*n*2 disappears. The release position can then be reached only when end section 416*c* is pushed onto operative cam-surface 412*n*1, i.e., provided the rotation of guide sleeve 414 is carried out in a specific direction.

The end hook 416*i* of wire strap 416*b* can be bent in a manner such as to cause neither damage nor gripping effects in centering tube 412, whenever it end hook reaches the release position when guide sleeve 414 is pulled out of centering tube 412, or when it is assembled, i.e., when guide sleeve 414 is inserted into centering tube 412.

The form of embodiment shown in FIG. 5 is distinguished by particularly economical production and particular safety from pullout.

Figure 6:
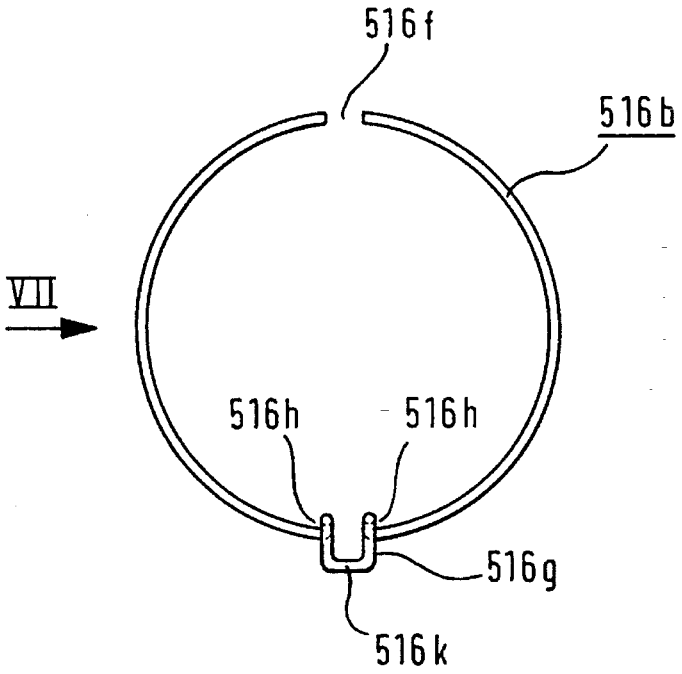
FIGS. 6, 7 and 8 are representations of different embodiments of a wire strap shown in FIG. 5.
Figure 7:
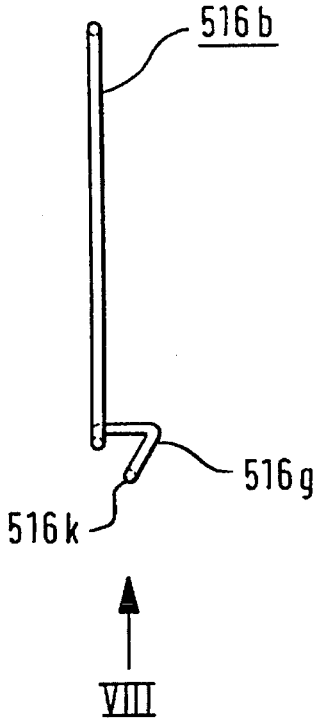
Figure 8:
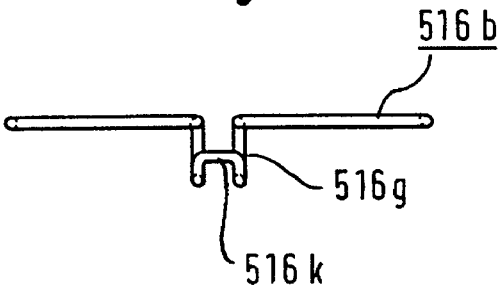

FIGS. 6, 7, and 8 show further forms of embodiment of the wire strap. FIG. 6 shows a top view of the wire strap, FIG. 7 a lateral view in the direction of arrow VII in FIG. 6, and FIG. 8 a lateral view in the direction of arrow VIII of FIG. 7. The entire wire strap is designated 516*b*. This wire strap features a slot 516*f* so that it can be easily inserted by expansion into the annular trough equivalent to 414*m* in FIG. 5. There is a section 516*g*, shaped as a hook, that is located diametrically opposite the slot. As can be seen in FIG. 6, this hook protrudes radially inward at 516*h* into the perimeter of wire strap 516*b*.

Wire strap 516*b* is inserted in guide sleeve 414*f* according to FIG. 5 in a manner such that hook-like section 516*g* protrudes forward. In such a case, projection 516*h* comes to lie in notch 414*n* so that wire strap 516*b* is fixed in annular trough 414*m* in an untwistable manner.

If guide sleeve 414 is positioned with respect to centering tube 412 in a manner such that hook 516*g* is outside recess 412*m*, hook 516*g* hooks with its radially outermost end 516*k* into stop edge 412*g* of centering tube 412 and is able to engage into gap 430. If, on the other hand, hook 516*g* is located in the region of recess 412*m*, it can be pushed radially inward into notch 414*n* of guide sleeve 414, by rotating guide sleeve 414 and with it hook 516*g*, the latter being pushed by at least one (and preferably by only one) of the cam surfaces 412*n*l and 412*n*2, then permitting guide sleeve 414 with wire strap 516*b* to be pulled out of centering tube 412.

I claim:

1. A column unit comprising:

a base tube having a base-tube axis, a first base-tube end, a second base-tube end, and guides within the base-tube in the region of the second base-tube end; and a positioning device having a device axis which substantially coincides with the base-tube axis, comprising a first component-group unit and a second component-group unit, wherein the first and second component-group units are axially movable relative to each other and are lockable against each other in a plurality of axial relative positions, the first component-group unit is supported on a support connected to the base tube, the second component-group unit extends beyond the second base-tube end and is adjustable between an innermost position and an outermost position with respect to the second base-tube end, an outer section of the second component-group unit, extending beyond the second base-tube end and beyond the guides, is shaped to connect with a column-borne object, the second component-group unit is in axially sliding engagement with the guides, the guides are guided along base tube in an axially shiftable manner such that, when the second component-group unit moves outward between its innermost position and its outermost position, the guides are driven on a partial path, and stop means for restricting the outward movement of the guides with respect to the second base-tube end including jointly acting pullout-restricting stops attached to the guides and to the base tube, the stop means being normally non-releasable by mere application of an axial pullout force upon the guides, but being capable of being rendered inoperative by at least one release operation different from the application of a pullout force.

2. The column unit of claim 1, wherein the first component-group unit is rotatable with respect to the support.

3. The column unit of claim 1, wherein the pullout-restricting stops are disposed to define an axially outermost limit position of the guides, in which position the second component-group unit, when located in the outermost position with respect to the second base-tube end, is optimally supported on the base tube.

4. The column unit of claim 1, wherein the pullout-restricting stops include a slot in a substantially axial direction in the base tube, and a slot-engagement member which engages into the slot and is connected with the guides for joint axial movement, the slot-engagement member acting jointly with a slot end to restrict the outward movement of the guides and being capable of disengagement from the slot.

5. The column unit of claim 4, wherein the slot-engagement member is releasable from the guides.

6. The column unit of claim 4, wherein the slot-engagement member is elastically displaceable with respect to the guides.

7. The column unit of claim 1, wherein the guides are twistable with respect to the base tube, the pullout-restricting stops being releasable, or capable of being placed in a release-ready position, by twisting the guides into a predetermined angular range in relation to the base tube.

8. The column unit of claim 1, wherein said support is axially substantially immovable with respect to the base tube.

9. The column unit of claim 1, wherein the guides are capable of being driven in at least one axial direction of motion by the second component-group unit, with clearance for movement, by means of driver- or pusher-stops.

10. The column unit of claim 9, further comprising a spring-steel claw-ring attached to an end section of the second component-group unit and facing the first base-tube end, the claw ring, upon an axially outward movement of the second component-group unit with respect to the base tube, coming to lie against a drive surface of the guides.

11. The column unit of claim 10, wherein the drive surface is formed by a shoulder surface between a radially internal guide surface of the guides and a larger-diameter recess of the guides.

12. The column unit of claim 7, wherein the pullout-restricting stops include an annular stop-edge within the base tube, oriented substantially axially to the first base-tube end, and a counter-stop on the guides, capable of being adjusted in a substantially radially inward direction from an operating position into a release position against elastic restoring force, the counter-stop being brought into the release position by camming upon twisting of the guides in the direction of the predetermined angular range.

13. The column unit of claim 12, wherein the counter-stop is disengagable into the release position by an operation which further comprises twisting of the guides with respect to the base tube subsequent to axial pullout.

14. The column unit of claim 7, wherein the pullout-restricting stops comprise an annular stop-edge within the base-tube, oriented in a substantially axial direction toward the first base-tube end, and a counter-stop on the guides, adjustable against an elastic force in a substantially radially inward direction, from an operating position into a release position, the counter-stop reaching the release-ready position upon twisting of the guides into the predetermined angular range, and being disengageable into a release position by a subsequent operation comprising axial pullout of the guides from the base tube.

15. The column unit of claim 14, wherein the stop-edge includes a recess, and wherein camming is provided adjacent to the recess on the base tube, for joint action with the counter-stop, the camming causing a transfer of the counter-stop into the release position, after introduction of the counter-stop into the recess and after a subsequent relative motion of the guides relative to the base tube.

16. The column unit of claim 15, wherein the camming is disposed such that the counter-stop is transferable within the recess into a release position upon axial pullout of the guides.

17. The column unit of claim 16, wherein the camming is disposed such that the counter-stop is transferable within the recess into a release position upon twisting of the guides with respect to the base tube.

18. The column unit of claim 17, wherein the counter stop is transferable into the release position upon uni-directional twisting of the guides.

19. The column unit of claim 12 or 14, wherein the stop-edge and the camming are disposed on a centering tube within the base tube at the second base-tube end.

20. The column unit of claim 12 or 14, wherein the counter-stop is formed by a section of a wire strap within an annular receiving trough on an external surface of the guides such that, when the section is in the region of a notch of the guides, which notch cuts into the annular trough, the section is displaceable radially inward into the release position, against an elastic force.

21. The column unit of claim 20, wherein the section of the wire strap is fixed to the guides in an non-twistable manner, being twistable into the angular range of a recess of the stop edge by twisting the guides with respect to the base tube, and wherein camming is provided on the base tube, adjacent to the recess, which camming, upon introduction of at least a part of said a section into the recess, transfers said section into the release position by means of a subsequent relative motion of the guides with respect to the base tube.

22. The column unit of claim 21, wherein the camming is disposed such that the section of the wire strap is transferable into the release position, after introduction into the recess, by means of rotation of the guides relative to the base tube.

23. The column unit of claim 22, wherein the camming is disposed such that the section of the wire strap is transferable into the release position, after introduction into the recess, by means of rotation of the guides relative to the base tube in one direction only.

24. The column unit of claim 21, wherein the section of the wire strap, when placed in an angular region outside the recess, engages in a hook-like manner into a radial gap between the stop-edge and an internal surface of the base tube.

25. The column unit of claim 24, wherein a radial gap, between a centering tube within the second base-tube end and an internal surface of the base tube, is formed by spacers.

26. The column unit of claim 12 or 14, wherein the guides are capable of being driven in at least one axial direction of motion by means of frictional engagement with the second component-group unit.

* * * * *

UNITED STATES PATENT AND TRADEMARK OFFICE

CERTIFICATE OF CORRECTION

PATENT NO. : 5,497,966

DATED : March 12, 1996

INVENTOR(S) : Castor Fuhrmann

It is certified that error appears in the above-indentified patent and that said Letters Patent is hereby corrected as shown below:

Col. 7, line 54, "junction" should read --junction of--;
Col. 10, line 54, "it" should read --its--;
Col. 13, line 23, "in an" should read --in a--;
Col. 13, line 28, "said a" should read --said--.

Signed and Sealed this

Twenty-seventh Day of August, 1996

*Attest:*

Bruce Lehman

BRUCE LEHMAN

*Attesting Officer*

*Commissioner of Patents and Trademarks*